US012495844B2

(12) United States Patent
Garneau

(10) Patent No.: US 12,495,844 B2
(45) Date of Patent: Dec. 16, 2025

(54) HOODED GARMENT

(71) Applicant: GESTION EDOUARD GARNEAU INC., Saint-Augustin-de-Desmaures (CA)

(72) Inventor: Édouard Garneau, Saint-Augustin-de-Desmaures (CA)

(73) Assignee: GESTION EDOUARD GARNEAU INC., Saint-Augustin-de-Desmaures (CA)

( * ) Notice: Subject to any disclaimer, the term of this patent is extended or adjusted under 35 U.S.C. 154(b) by 41 days.

(21) Appl. No.: 18/329,854

(22) Filed: Jun. 6, 2023

(65) Prior Publication Data

US 2023/0389629 A1 Dec. 7, 2023

Related U.S. Application Data

(60) Provisional application No. 63/349,207, filed on Jun. 6, 2022.

(51) Int. Cl.
*A41D 13/00* (2006.01)

(52) U.S. Cl.
CPC ..... *A41D 13/001* (2013.01); *A41D 2200/20* (2013.01)

(58) Field of Classification Search
CPC ..... A41D 13/001; A41D 13/1153; A41D 2200/20; A62B 17/04; A01K 55/00; A42B 5/00; A42B 1/014
See application file for complete search history.

(56) References Cited

U.S. PATENT DOCUMENTS 1,020,083 A * 3/1912 Donald ..... A42B 5/00 2/207
1,576,023 A * 3/1926 Barberis ..... A41D 3/08 2/87
3,561,010 A 2/1971 Little
5,560,043 A * 10/1996 Armstrong ..... A41D 15/00 2/85
5,713,077 A * 2/1998 Humbrecht ..... A42B 1/0182 2/202

(Continued)

FOREIGN PATENT DOCUMENTS

JP 08246208 A * 9/1996 ..... A41D 3/00
WO 2016/007603 A1 1/2016

*Primary Examiner* — Patrick J. Lynch
(74) *Attorney, Agent, or Firm* — NORTON ROSE FULBRIGHT CANADA LLP

(57) ABSTRACT

A hooded garment may include a torso portion configured to be worn over a wearer's torso, the torso portion defining a neck opening configured to surround a neck when worn. A hood is connected to the torso portion and a face opening. A screen has a mesh panel, an edge portion secured to the hood in a vicinity of the face opening, and a free edge portion. Connector is or are inside a head-receiving volume and/or torso portion at least in a posterior half of the hooded garment. A complementary connector(s) is on the free edge portion of the screen. The screen is movable between a screening configuration in which the mesh panel screens the face opening, and a stowed configuration in which the free edge portion is connected to the inside of the head-receiving volume and/or torso portion via engagement of the at least one connector with the at least one complementary connector.

14 Claims, 4 Drawing Sheets

(56) References Cited

U.S. PATENT DOCUMENTS

| | | | | |
|---|---|---|---|---|
| 5,794,263 | A | 8/1998 | Carman | |
| 5,845,340 | A | 12/1998 | Frislie | |
| 6,272,690 | B1 * | 8/2001 | Carey | A41D 13/1153 2/9 |
| 2004/0000332 | A1 * | 1/2004 | Yang | A45B 11/04 135/15.1 |
| 2008/0120762 | A1 | 5/2008 | Huang | |
| 2018/0042311 | A1 * | 2/2018 | Carraro | A42B 1/048 |
| 2018/0146733 | A1 * | 5/2018 | Greenblat | A42B 1/046 |
| 2022/0273051 | A1 * | 9/2022 | Occhicone | A41D 13/015 |
| 2022/0400782 | A1 * | 12/2022 | Lindsay | A41D 13/001 |

* cited by examiner

HOODED GARMENT

CROSS-REFERENCE TO RELATED APPLICATION

The present application claims the priority of U.S. Patent Application No. 63/349,207 filed on Jun. 6, 2022 and incorporated herein by reference.

TECHNICAL FIELD

The application relates to hooded garments such as sweatshirts, shirts, jackets and the like used in outdoor activities.

BACKGROUND

Numerous outdoor activities take place from early April to August, in what is also referred to as bug season depending on the region or country. Accordingly, exposed skin surfaces are at the mercy of flying insects such as mosquitoes, blackflies, wasps and other invasive insects. Insect bites can cause discomfort, and may further result in some health concerns: rash, allergic reactions, parasitic diseases, etc.

One solution is to use insect repellent on one's skin. However, the efficacy of such products has been questioned. Moreover, insect repellents have also been known to cause skin irritation, notably because of the presence of chemicals.

Another solution consists in screening oneself. A known type of shield consists of a hat from which a screen is hung to cover a user's head. There are issues of practicality with such hats, as they tend to be relatively large, cumbersome and non-aesthetic.

SUMMARY

In one aspect, there is provided a hooded garment comprising: a torso portion configured to be worn over a wearer's torso, the torso portion defining a neck opening configured to surround a neck when worn; a hood connected to the torso portion, the hood defining a head-receiving volume communicating with the neck opening and configured to receive a wearer's head, the hood having a face opening; a screen having a mesh panel, an edge portion secured to the hood in a vicinity of the face opening, and a free edge portion; at least one connector inside the head-receiving volume and/or torso portion at least in a posterior half of the hooded garment; and at least one complementary connector on the free edge portion of the screen; wherein the screen is movable between a screening configuration in which the mesh panel screens the face opening, and a stowed configuration in which the free edge portion is connected to the inside of the head-receiving volume and/or torso portion via engagement of the at least one connector with the at least one complementary connector.

In another aspect, there is provided a method for screening a hooded garment comprising: detaching a free edge portion of a screen from an interior of a hooded garment in a posterior half of the hooded garment, while another edge portion remains connected to an interior of a hood of the hooded garment; pulling the screen via the free edge portion in front of a wearer's face, with the hood covering a top of the wearer's head; and tucking the free edge portion of the screen inside the hooded garment via a bottom of a face opening of the hood.

DESCRIPTION OF THE DRAWINGS

Reference is now made to the accompanying figures in which.

DETAILED DESCRIPTION

Figure 1:
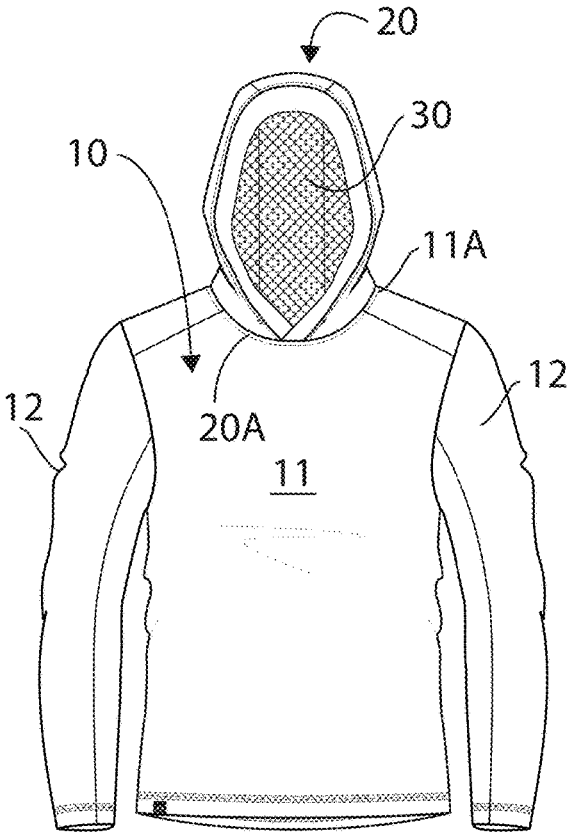
FIG. 1 is a front view of a hooded garment in accordance with a variant of the present disclosure.

Referring to the drawings and more particularly to FIG. 1, a hooded garment in accordance with the present disclosure is generally shown at 10. The hooded garment 10 is shown as being a pull-on top, such as in the form of a sweater, a jacket, a sweatshirt, a vest, among other possibilities. The hooded garment 10 may also be known as a hoodie. Therefore, the hooded garment 10 has a torso portion 11, with a front panel and a rear panel. The torso portion 11 is configured to cover a torso of a wearer.

A neck opening 11A is at a top of the torso portion. The neck opening 11A may also be known as a collar, a shirt opening, etc. It is through the neck opening 11A that one passes his/her head, with the neck being through the neck opening 11A. Sleeves 12 may project laterally from the torso portion 11. The sleeves 12 are shown as being long sleeves, but the hooded garment 10 could also be a short-sleeved top, a sleeveless vest, or may have any other configuration.

The hooded garment 10 may be made of any appropriate material, and may have one or more layers. For example, the hooded garment 10 may include some fabrics made of natural fibers, synthetic fibers, blends thereof. The hooded garment 10 is not limited to any particular type of fabric or textile. The hooded garment 10 may be insulated or have insulation layers, may be waterproof or water-resistant, and may have many other features including pockets, such as lateral pockets, back pockets, chest pockets, kangaroo pockets, zippers, vents, waist elastics, to name just a few of numerous features that may optionally be present on the hooded garment 10.

Figure 2:
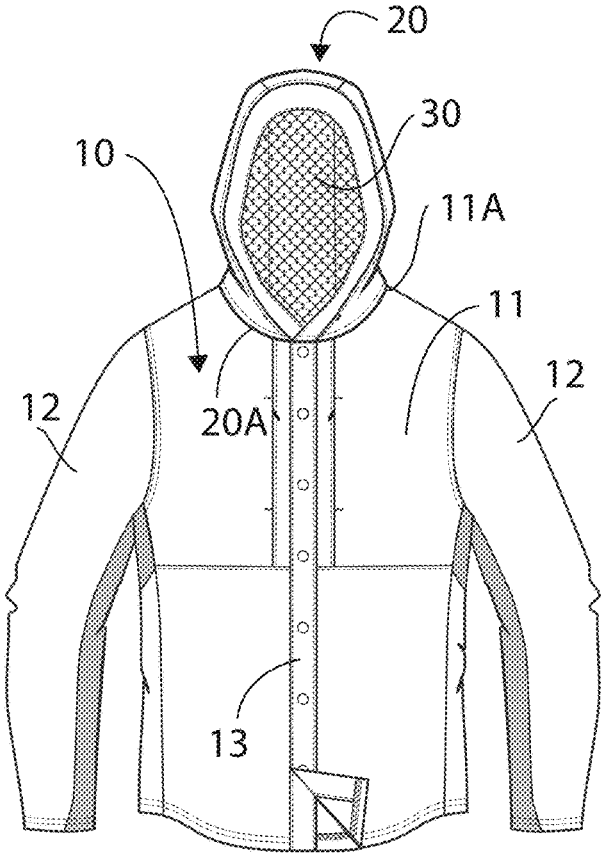
FIG. 2 is a front view of a hooded garment in accordance with another variant of the present disclosure.

As an example, FIG. 2 shows another hooded garment 10 similar to the one of FIG. 1, but with a front packet 13 that has buttons thereon, such that the hooded garment 10 is akin to a shirt with a front opening, as opposed to the pull-on top of FIG. 1. As alternatives to buttons, the hooded garment 10 of FIG. 2 may have a zipper closure, Velcro® closure, etc.

A hood 20 projects upwardly from the torso portion 11. The hood 20 may also be known as a cap, as a cowl. In a variant, the hood 20 meets the torso portion 11 at the neck opening 11A, for instance via a neck seam 20A. However, it is also considered to have the hood 20 being seamlessly connected to the torso portion 11, such as by having the hood 20 being part of the same fabric panels as part of the torso portion 11. The hood 20 in FIGS. 1 and 2 is shown as being in a head-covering configuration, i.e., standing upward as it would when convering a wearer's head. It is however possible to fold it back so as to free the wearer's head from the hood 20.

As also observed from FIGS. 1 and 2, a screen 30 is shown extending across a face opening of the hood 20. Accordingly, when the hooded garment 20 worn in the manner shown in FIGS. 1 and 2, the face opening of the hooded garment 10 is covered such that a face shield is formed, the face shield being referred to as a bug net, a bug screen, etc. In contrast to a solid face shield, the screen 30 is a mesh, allowing air to pass through it. The screen 30 is described in further detail hereinafter.

Figure 3:
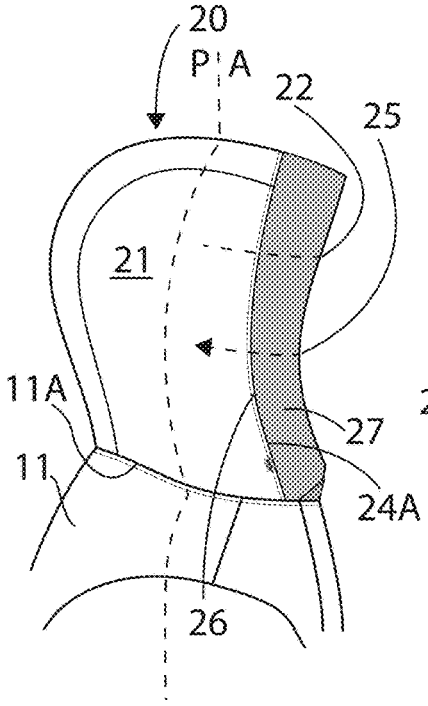
FIG. 3 is a side view of a hood of the hooded garment of the present disclosure, illustrating an interlining.
Figure 4:
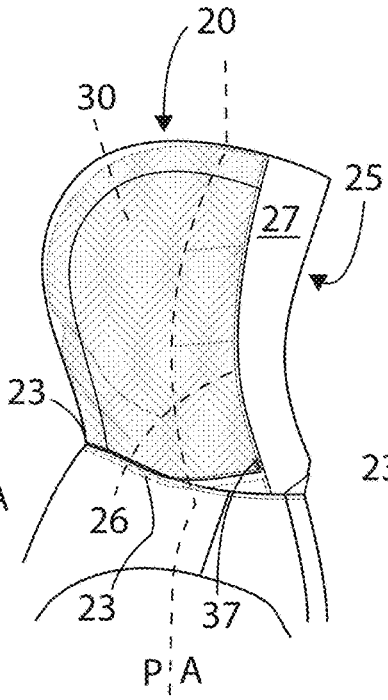
FIG. 4 is a see-through side view of the hood of FIG. 3, showing a screen in a stowed configuration.
Figure 5:
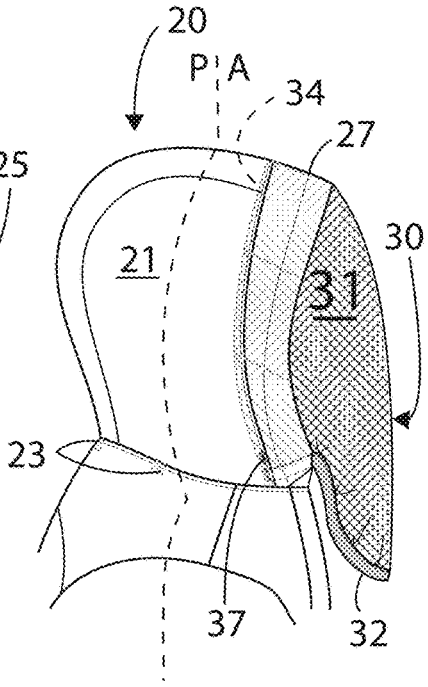
FIG. 5 is another view of the hood of FIG. 3, showing the screen in a deployed configuration.

Referring now to FIGS. 3 to 5, the hood 20 is shown in greater detail. FIGS. 3 to 5 are shown with a stippled line indicating a demarcation between a posterior half and an anterior half of the hooded garment 10, the posterior half shown as P, while the anterior half is shown as A. The positioning of the stippled line is approximately placed in FIGS. 3 to 5. In a variant, the posterior half P and the anterior half A are separated by a frontal plane of the wearer of the garment 10.

The hood 20 has an outer surface 21 and an inner surface 22. The outer surface 21 may be said to be the surface that faces away from a wearer's head, while the inner surface 22 may be said to be the surface that is opposite the wearer's head when the hood 20 is in the head-covering configuration as in FIGS. 1 to 5. One or more connectors 23 are located inside the hooded garment 10, such as on the inner surface of the hood 20. However, the connectors 23 may also be secured inside the torso portion 11. In a variant, there are different connectors 23, with some located on the inner surface 22 of the hood 20 and others located in the torso portion 11. In an embodiment, the connectors 23 are overlaid on the neck seam 20A, and therefore, may overlap between the inner surface 22 of the hood 20 and an inner surface of the torso portion 11. In such an embodiment, the stitching on the neck seam 20A may be used to secure the connector 23 to the hooded garment 10.

Figure 6:
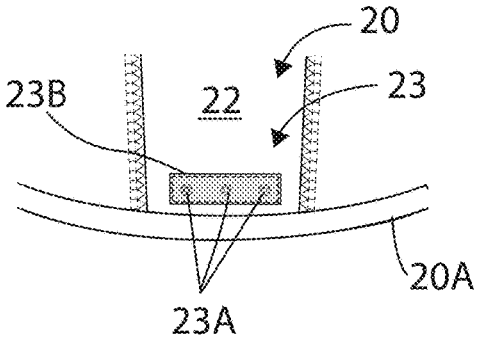
FIG. 6 is an enlarged view of one type of connector used inside the hood of the hooded garment of the present disclosure.

Referring to FIG. 6, one variant of the connector 23 is shown. The connector 23 has three distinct snap connectors 23A on a same tape 23B, though a one, two or more than three snap connectors 23A may be present. The tape 23B is secured (e.g., stitched) to the inner surface 22 of the hood 20, but may be secured to an interior of the torso portion 11. The snap connectors 23A may be female connectors that would operate with complementary male connectors on the screen 30. The reverse arrangement is also possible.

Also, while the tape 23B is shown as being stitched to the interior of the hooded garment 10, the tape 23B could be fused, glued and/or attached in any other appropriate manner. It is also considered to have the snap connectors 23A attached directly to the inner surface 22 or to the torso portion 11, i.e. without the tape 23B.

Figure 8:
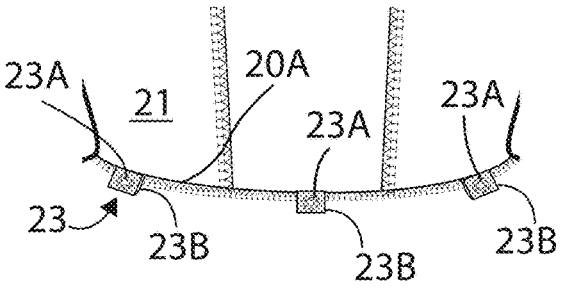
FIG. 8 is an enlarged view of another type of connector used inside the hood of the hooded garment of the present disclosure.

Referring to FIG. 8, another configuration of the connector 23 is shown, in which three discrete connectors 23 are provided. The three discrete connectors 23 may also have snap connectors 23A, each with its own tape 23B. These tapes 23B may be folded on themselves and then secured at the neck seam 20A, as one possible arrangement among others. Alternatively, it is considered to have the connectors 23A secured directly to the inner surface 22 of the hood 20 and/or to an inner surface of the torso portion 11. The tape 23B, if present, can be secured in any appropriate way to the inner surface 22 of the hood or to an inner surface of the torso portion 11.

Returning to FIGS. 4 and 5, it can be seen that at least some of the connectors 23 are located in the posterior half P of the hooded garment 10. In a variant, the connectors 23 are all in the posterior half P of the hooded garment 10. The connectors 23 of FIGS. 6 and 8 are only two embodiments among numerous other configurations of connectors 23 that are on the inside of the hooded garment 10. Other systems may include complementary magnet portions (e.g., pairs of permanent magnet(s) and ferromagnetic member(s)), zipper closures, Velcro® as solutions among others.

Referring to FIGS. 3 to 5, the hood 20 defines a head-receiving volume 24 that has a face opening 25. The head-receiving volume 24 is the cavity that accommodates a wearer's head. The head-receiving volume 24 may be said to have an edge 24A or seam that is inward of a frontmost edge of the hood 20, as the edge 24A may be the forward boundary of the main material of the hood 20. The edge 24A may have a zipper tape 26 that includes a zipper closure half, such as a series of teeth or the like (e.g., Ziplock® type closure). The edge 24A may be defined as being that of the main material of the hood 20, with an additional feature such as a rigidizing band 27 (e.g., rigidizer) connected to the edge 24A and projecting anteriorly therefrom, such that the rigidizing band 27 defines the anterior-most edge of the hood 20 in the head-covering configuration. The rigidizing band 27 may be understood to be a visor, and in an embodiment has a greater structural integrity that the main material of the hood 20. Said differently, while the main portion of the hood 20 may be made of a fabric that may collapse by gravity, the rigidizing band 27 is configured to maintain its shape in spite of gravity. For example, the main material of the hood 20 may mainly be a textile or fabric, while the rigizidizing band 27 may have a material that is not a textile or fabric. In an embodiment, the rigidizing band 27 may also be known as an interlining, and may use plastic film welding or other technique to have a cardboard-like rigidity, and/or may include a rod, polymeric sheet or like structural component that help the rigidizing band 27 maintaining its shape. The rigidizing band 27 is optional and may project from the edge 24A. The rigidizing band 27 may completely surround the face opening 25, or may partially surround the face opening 25, such as by being merely in an upper region of the face opening 25. Moreover, although not shown, the rigidizing band 27, if present, may be covered by the main material of the hood 20 so as to be concealed.

Still referring to FIGS. 3 to 5, the screen 30 (also known as net) is shown as being attached to the edge 24A. Therefore, if a rigidizing band 27 is provided on the hood 20, the screen 30 is connected to the hood 20 inward of the rigidizing band 27. The screen 30 may be secured to the inner surface 22 of the hood 20, or may be attached to the hood 20 via the zipper tape 26 as described below. The rigidizing band 27 may ensure that the hood 20 maintains it shape at its anterior end, even though the screen 30 is hanging freely therefrom in the manner shown in FIG. 5. This may be desired to avoid having the hood 20 obstruct a wearer's sight. Moreover, the rigidizing band 27 may act as a visor to shield the wearer's eyes from the sun or the rain in a similar way as a cap would. However, it is considered to have the screen 30 be connected to an anterior-most edge of the hood 20 as well.

The screen 30 typically consists of a mesh panel 31 or net. The mesh panel 31 may be selected to have openings that are as a function of the insects that could affect the wearer. The screen 30 has a free edge portion that is not secured to the hood 20 when in a deployed configuration shown, as in FIG. 5. As observed, an edge band 32 may be provided on the free edge portion of the screen 30, to accommodate a bottom edge portion of the mesh panel 31. The edge band 32 may be a fabric band, such as a crease elastic as a possibility, that receives the bottom ege portion of the mesh panel 31, with a stitch to close the edge band 32 on itself. The edge band 32 may be present in order to protect a bottom edge of the mesh panel 31 and prevent same from fraying.

Figure 7:
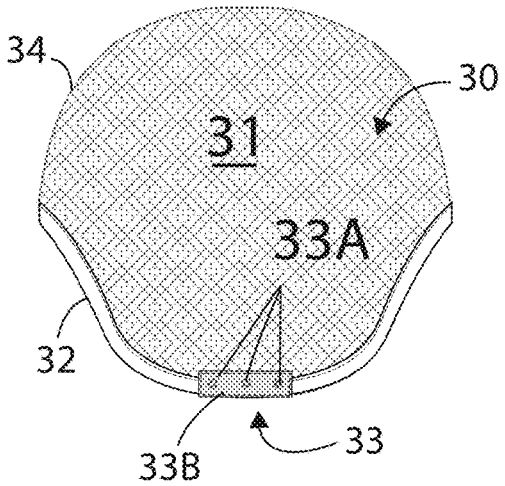
FIG. 7 is an enlarged view on a connector complementary to the connector of FIG. 6, on the screen of the hooded garment of the present disclosure.

Referring to FIG. 7, a connector(s) 33 is provided on the free edge portion of the screen 30 and more particularly on the edge band 32 of present. The connector 33 be shown in FIG. 7 is complementary in configuration to the connector 23 of FIG. 6. For example, in FIG. 7, the connector 33 includes three snap connectors 33A that are positioned and spaced apart to correspond to the snap connectors 23A of FIG. 6. A tape 33B may also be present, though not necessary. If the connectors 23A are male connectors, then the connectors 33A are female connectors, and vice versa. Therefore, when the connectors 33 are positioned face to face with the connectors 23 in a stowed configuration of the screen 30 shown in FIG. 4, a simple pressure may result in a snapping of the connectors 33 to the connectors 23.

Figure 9:
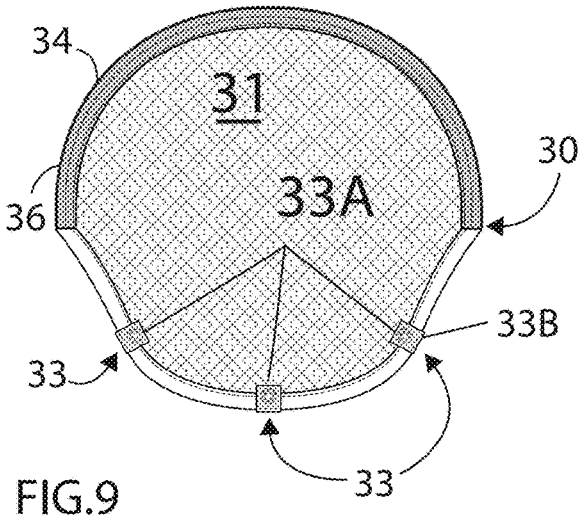
FIG. 9 is an enlarged view on a connector complementary to the connector of FIG. 8, on the screen of the hooded garment of the present disclosure.

FIG. 9 shows another configuration for the connectors 33, that is complementary to the connector 23 configuration of FIG. 8. More particularly, three distinct connectors 33 are present, with the same spacing therebetween. The three discrete connectors 33 may also have snap connectors 33A (complementary to connectors 23A of FIG. 8, such as male to female or vice versa), each with its own tape 23B. These tapes 33B may be folded on themselves and then secured at the edge band 23 if present, as one possible arrangement among others. Alternatively, it is considered to have the connectors 33A secured directly to the edge band 32 or to the mesh panel 31. The tape 33B, if present, can be secured in any appropriate way to the screen 30. If the connectors 23 and 33 are of different nature, such as Velcro®, zipper closure, etc, complementary pairs are provided at 23 and 33.

The screen 30 is connected to the hood 20 by way of its hood connection edge portion 34. In a variant, the hood connection edge portion 34 has a zipper tape 36 or like zipper closure half, complementary Velcro® strip, or Ziplock® type closure, i.e., similar to a zipper, but with mating elongated extrusions mating by way of a slider. The zipper tape 36 is configured to correspond to the zipper tape 26 for complementary interconnection. Therefore, by way of the slider 37 shown in FIGS. 4 and 5, it is possible to zip or unzip the screen 30 to the hood 20. Therefore, the screen 30 may be completely removed such as when a user wants to wear the hooded garment 10 without the screen 30. In an embodiment, the screen 30 may be permanently secured to the hood 20.

It can be observed from FIG. 4 that, in the stowed configuration, the mesh panel 31 is generally laid against an inner surface 22 of the hood 20. The mesh panel 31 may be sized so as to generally correspond in size to the inner surface of the hood 20 as worn. For example, a length of the inner surface 22, from the edge 24A to the connector(s) 23 may be generally equal to or within ±15% of the height of the screen 30, i.e., from the connector(s) 33 to the hood connection edge portion 34. Stated differently, the shield 30 has a length (or height) from the edge portion 34 to the complementary connector 33 that is equivalent to 85%-115% of a distance of the inner surface 22 of the hood 20 from the edge 24A of the hood 20 (to which the edge portion of the screen is connected) to the connector 23. When there are multiple connectors 23 and 33, the distances are to the central one and/or to the farthest one. The distance may be from 98%-120% in a variant. Accordingly, when in the stowed configuration, the screen 30 may not bunch up, with the hood 20 having a similar to a wearer as a hood 20 without the screen 30. Such a length or dimensional correspondence may result in the screen 30 descending below a bottom of the face opening 25, as shown in FIG. 5. However, the free edge portion of the shield 30 may simply be tucked into the hood 20, in the manner shown in FIGS. 1 and 2. The additional loose material may not impede freedom of movement of the wearer, and/or may ensure that the face opening 25 is completely screened, when the shield 30 is properly tucked in. It is recommended that the shield 30 is indeed tucked in, as the arrangement of FIG. 5 without such a tuck may present a passage for bugs. Stated differently, it can be seen in FIG. 5 that the screen 30 is in its deployed configuration. However, while FIG. 5 shows that the screen 30 projects downwardly out of the torso portion 11, it is possible to fit the bottom portion of the screen 30, shown as hanging freely in FIG. 5, into the hooded garment 10 in the manner shown in FIGS. 1 and 2.

Figure 10:
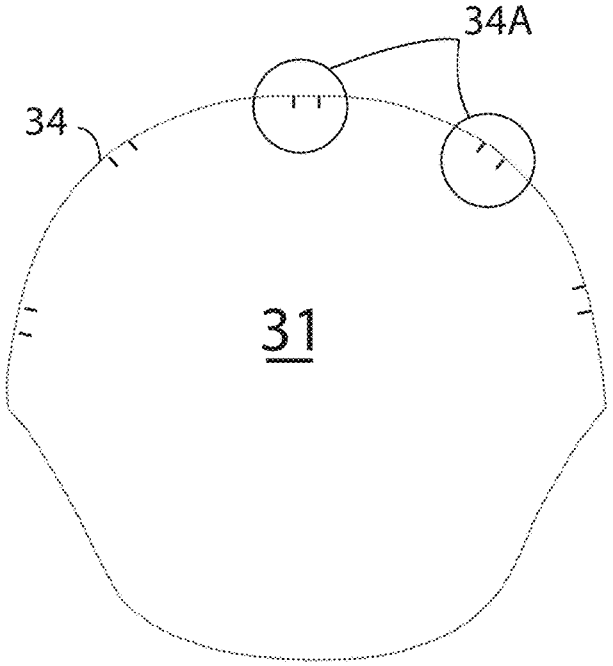
FIG. 10 is a front view of a mesh panel of the screen of the hooded garment of the present disclosure.
Figure 11:
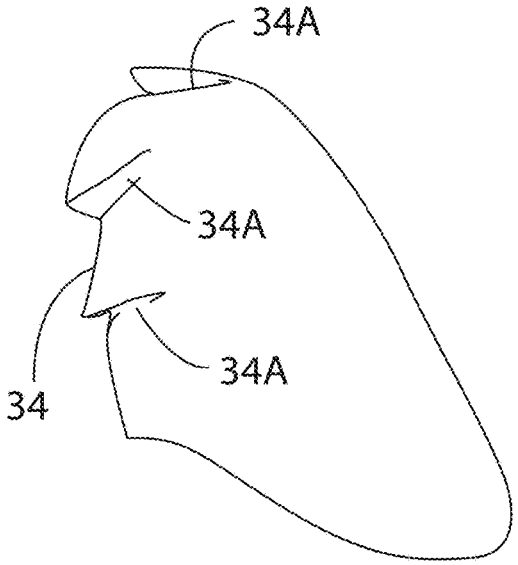
FIG. 11 is a perspective view of the Pattern for the mesh panel showing its three-dimensional configuration.

Referring to FIGS. 10 and 11, it can be seen that some seams and folds 34A may be provided on the hood connection edge portion 34. In a variant, the marks 34 of FIG. 10 are where the mesh panel 31 is folded onto itself and stitched, fused, and/or attached, etc. This may be done so as to give the screen 30 a three-dimensional shape as opposed to being flat when laid on a flat surface. This may help the screen 30 adopt an anatomical geometry that will be more comfortable to the wearer.

The hooded garment 10 in all of its embodiments and/or variants described herein can be used according to a method for screening a hooded garment that may include one or more of: detaching a free edge portion of a screen from an interior of a hooded garment in a posterior half of the hooded garment, while another edge portion remains connected to an interior of a hood of the hooded garment; pulling the screen via the free edge portion in front of a wearer's face, with the hood covering a top of the wearer's head; and/or tucking the free edge portion of the screen inside the hooded garment via a bottom of a face opening of the hood In a variant, detaching the free edge portion includes unclipping the free edge portion. In a variant, unclipping the free edge portion includes separating a plurality of complementary snap fit connectors. In a variant, the screen is zipped to the interior of the hooded garment in an anterior half, prior to the detaching. In a variant, the screen is stowed back into the interior of the hooded garment and attaching the free edge portion to the interior of the hooded garment. In a variant, attaching the free edge portion includes clipping the free edge portion. In a variant, clipping the free edge portion includes snap-fitting a plurality of complementary snap fit connectors. Such a method may entirely be performed by the wearer with the hooded garment 10 or like hooded garments.

For clarity, the free edge portion may be described as being the portion of the screen 30 that hangs free from the hood 20 while a remainder of the screen 30 is attached to the hood. The free edge portion may be longer than the hood connection edge portion.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A hooded garment comprising:

a torso portion configured to be worn over a wearer's torso, the torso portion defining a neck opening configured to surround a neck when worn;

a hood connected to the torso portion, the hood defining a head-receiving volume communicating with the neck opening and configured to receive a wearer's head, the hood having a face opening;

a screen having a mesh panel, an edge portion secured to the hood in a vicinity of the face opening, and a free edge portion;

at least one connector inside the head-receiving volume or in the torso portion, the at least one connecter being in a posterior half of the hooded garment; and at least one complementary connector on the free edge portion of the screen;

wherein the screen is movable between a screening configuration in which the mesh panel screens the face opening, and a stowed configuration in which the free edge portion is connected to the inside of the head-receiving volume and/or torso portion via engagement of the at least one connector with the at least one complementary connector; and wherein the screen has a length from the edge portion to the at least one complementary connector that is longer than and up to 120% of a distance of an inner surface of the hood from an edge of the hood, to which the edge portion of the screen is connected, to the at least one connector.

2. The hooded garment according to claim 1, wherein the at least one connector and the at least one complementary connector include at least one male snap connector and at least one female snap connector configured for complementary snap-fit engagement.

3. The hooded garment according to claim 2, including a plurality of the male snap connector on a common tape, and a plurality of the female snap connector on another common tape.

4. The hooded garment according to claim 1, wherein the at least one connector overlaps a seam between the hood and the torso portion.

5. The hooded garment according to claim 1, including a plurality of the at least one connector, the plurality being entirely in the posterior half.

6. The hooded garment according to claim 1, including a zipper closure releasably securing the screen to the hood at the edge portion, such that the screen is fully detachable from the hood.

7. The hooded garment according to claim 1, including a band on the free edge portion of the screen.

8. The hooded garment according to claim 7, wherein the band is an elastic with a crease to receive the free edge portion of the screen.

9. The hooded garment according to claim 7, wherein the at least one complementary connector is attached to the band.

10. The hooded garment according to claim 1, including a rigidizer band along at least part of an edge of the hood.

11. The hooded garment according to claim 10, wherein the band extends along all of the face opening of the hood.

12. The hooded garment according to claim 10, wherein the rigidizer band is positioned anteriorly of the edge portion of the screen.

13. The hooded garment according to claim 1, wherein the at least one connector and the at least one complementary connector include one of magnetically attracting components, a zipper with teeth, or a zipper with mating extrusions.

14. The hooded garment according to claim 1, wherein the mesh panel is folded onto itself to form seams projecting from the edge portion of the mesh panel, whereby the screen has a three-dimensional shape.

* * * * *